US008875689B2

(12) United States Patent
Chor-Ming

(10) Patent No.: US 8,875,689 B2
(45) Date of Patent: Nov. 4, 2014

(54) APPARATUS AND METHOD FOR DETECTING THE DART IN A BARREL OF A TOY GUN

(75) Inventor: Ma Chor-Ming, Tsim Sha Tsui (HK)

(73) Assignee: Buzz Bee Toys (H.K.) Company Limited, Kowloon (HK)

( * ) Notice: Subject to any disclaimer, the term of this patent is extended or adjusted under 35 U.S.C. 154(b) by 351 days.

(21) Appl. No.: 13/274,014

(22) Filed: Oct. 14, 2011

(65) Prior Publication Data

US 2012/0285436 A1 Nov. 15, 2012

(30) Foreign Application Priority Data

May 13, 2011 (CN) ..... 2011 1 0124381
May 13, 2011 (HK) ..... 11104743

(51) Int. Cl.

| | |
|---|---|
| ***F41B 7/08*** | (2006.01) |
| ***F41B 11/00*** | (2013.01) |
| ***F41B 11/89*** | (2013.01) |
| ***F41B 11/54*** | (2013.01) |
| ***F41B 7/00*** | (2006.01) |
| ***F41A 15/02*** | (2006.01) |
| ***F41A 9/53*** | (2006.01) |
| ***F41A 9/27*** | (2006.01) |

(52) U.S. Cl.

CPC ..... *F41B 7/006* (2013.01); *F41B 11/89* (2013.01); *F41B 7/08* (2013.01); *F41B 11/54* (2013.01); *F41A 15/02* (2013.01); *F41A 9/53* (2013.01); *F41A 9/27* (2013.01)

USPC ..... 124/80; 124/41.1; 124/45; 124/48; 124/51.1; 124/56; 124/82

(58) Field of Classification Search

CPC ..... F41B 11/50; F41B 11/54; F41B 11/89; F41B 7/006

USPC ..... 124/41.1, 45, 51.1, 56, 80, 82, 48

See application file for complete search history.

(56) References Cited

U.S. PATENT DOCUMENTS

| | | | | |
|---|---|---|---|---|
| 2,921,573 | A * | 1/1960 | Horowitz et al. | 124/27 |
| 3,111,121 | A * | 11/1963 | Baggott | 124/67 |
| 5,284,274 | A * | 2/1994 | Lee et al. | 222/79 |
| 5,381,928 | A * | 1/1995 | Lee et al. | 222/79 |
| 5,515,837 | A * | 5/1996 | Nin et al. | 124/59 |
| 7,677,235 | B2 * | 3/2010 | Zimmerman | 124/66 |
| 8,127,753 | B1 * | 3/2012 | Brooks et al. | 124/66 |
| 8,387,605 | B2 * | 3/2013 | Brown et al. | 124/27 |
| 8,402,956 | B2 * | 3/2013 | Dakan et al. | 124/27 |
| 8,596,254 | B2 * | 12/2013 | Brooks et al. | 124/52 |
| 2010/0147277 | A1 * | 6/2010 | Zimmerman et al. | 124/56 |
| 2011/0036338 | A1 * | 2/2011 | Wei | 124/80 |
| 2011/0041821 | A1 * | 2/2011 | Brown et al. | 124/27 |
| 2012/0037135 | A1 * | 2/2012 | Dakan et al. | 124/16 |
| 2012/0125304 | A1 * | 5/2012 | Brooks et al. | 124/52 |
| 2012/0240912 | A1 * | 9/2012 | Hu | 124/80 |

* cited by examiner

*Primary Examiner* — Gene Kim
*Assistant Examiner* — Alexander Niconovich
(74) *Attorney, Agent, or Firm* — Raymond R. Ferrera; Adams and Reese LLP

(57) ABSTRACT

An apparatus for detecting the dart in a barrel of a toy gun is provided. The apparatus includes a dart sensor lever, a linkage, a transmission mechanism between the dart sensor lever and the linkage, and a pivot attached to the gun body. The dart sensor lever is linked with the pivot so that it will swing around the pivot. The transmission mechanism is linked with the linkage, which causes the linkage to move. Other modifications and features suitable for practice therewith, and methods and means of operating the device, are also disclosed.

6 Claims, 2 Drawing Sheets

APPARATUS AND METHOD FOR DETECTING THE DART IN A BARREL OF A TOY GUN

CROSS-REFERENCE TO RELATED APPLICATIONS

Pursuant to 35 U.S.C. 119(a), the instant application claims priority to prior Hong Kong application number 11104743.9, filed May 13, 2011; and People's Republic of China application number 201110124281.0, filed May 13, 2011.

FIELD OF THE INVENTION

The present invention relates to a transmission apparatus and a transmission method, more particularly, to an apparatus and a method for detecting the dart in a barrel of a toy gun.

BACKGROUND OF THE INVENTION

As toy guns loaded with foam darts are with fun and safety, they are popular with children. The foam darts usually have separate darts and barrels. After being loaded into the barrels, the darts together with the barrels are then loaded into the magazines. In the prior art, in order to re-load new darts, a player has to take out the magazine and release the barrel when all the darts have been fired. The solution has drawbacks that such cumbersome procedures may affect the game progress and emotion of the players when they are in the exciting game with the toy gun. However, since there are darts in the barrels or not, only barrels are not enough for the toy guns. If the barrels with darts are ejected, it will cost the waste of darts.

SUMMARY OF THE INVENTION

It is an object of the present invention to provide an apparatus and a method for detecting the dart in a barrel of a toy gun, which is capable of detecting whether or not there is a dart in the barrel, aiming at the drawbacks that darts can be wasted since a barrel with a dart may be ejected during the ejection of the barrel in the prior art.

An apparatus for detecting the dart in a barrel of a toy gun is provided, which comprises a dart sensor lever, a linkage, a transmission mechanism between the dart sensor lever and the linkage, and a pivot attached to the gun body; wherein, the dart sensor lever is linked with the pivot to swing around it, and the transmission mechanism is linked with the linkage for driving the linkage to move.

In the apparatus for detecting the dart in a barrel of a toy gun according to the embodiment of the present invention, a contacting end of the dart sensor lever is linked to the transmission mechanism while a free end of the dart sensor lever droops at the position where the head part of the dart in the barrel is located.

In the apparatus for detecting the dart in a barrel of a toy gun according to the embodiment of the present invention, the contacting end of the dart sensor lever is provided with a hook and the transmission mechanism is provided with a corresponding groove coordinating with the hook.

In the apparatus for detecting the dart in a barrel of a toy gun according to the embodiment of the present invention, the transmission mechanism is a connecting rod which is linked to the contacting end of the dart sensor lever.

In the apparatus for detecting the dart in a barrel of a toy gun according to the embodiment of the present invention, the contacting end of the dart sensor lever leans to the transmission mechanism; and the contacting surface of the transmission mechanism is an inclined plane.

It is another object of the present invention to provide a method for detecting the dart in a barrel of a toy gun, wherein, the above mentioned apparatus is utilized in the method; when a free end of a dart sensor lever is lapped with a dart, the method comprises the following steps:

the free end of the dart sensor lever is moved by the dart so that the dart sensor lever swings around a pivot;

a contacting end of the dart sensor lever presses a transmission mechanism linked therewith so as to move the transmission mechanism;

the transmission mechanism drives a linkage linked therewith to move so as to transmit the information whether or not there is a dart in the barrel.

The advantageous effects of the present invention are: with the apparatus and the method for detecting the dart in a barrel of a toy gun according to the present invention, a barrel with a dart therein will not be ejected out by mistake, while just an empty barrel will be ejected out.

These and other advantages, aspects and novel features of the present invention, as well as details of an illustrated embodiment thereof, will be more fully understood from the following description and drawings.

BRIEF DESCRIPTION OF THE DRAWINGS

The present invention is further described with reference to the accompanying drawings and embodiments in the following. In the Figures.

DETAILED DESCRIPTION OF THE PREFERRED EMBODIMENT

Figure 1:
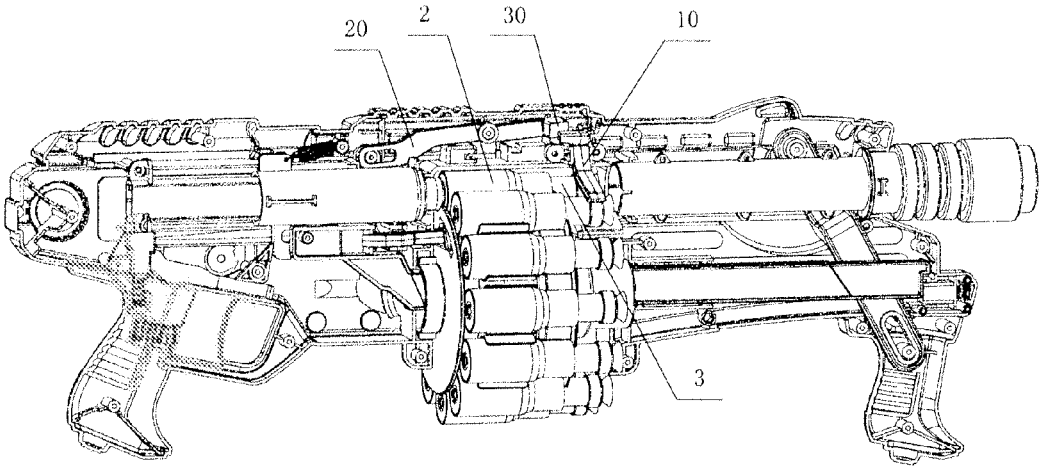
FIG. 1 is a structure diagram for an apparatus for detecting the dart in a barrel of a toy gun and the toy gun with the apparatus thereof according to the embodiment of the present invention.

Hereinafter, in order to make the objectives, technical solution and advantages of the present invention clearer, the present invention will be described in detail with reference to the accompanying drawings and embodiments. It should be understood that the specific embodiments herein are only provided for explanation purpose instead of limiting the present invention. Reference should now be made to the drawings, in which the same reference numerals are used throughout the different drawings to designate the same or similar components.

As shown in FIGS. 1 to 3B, only for illustrating purpose, an apparatus for detecting the dart in a barrel of a toy gun and the toy gun with the apparatus for detecting the dart in a barrel thereof according to the embodiment of the present invention is shown in FIG. 1. Referring to FIG. 1, the apparatus for detecting the dart in a barrel of a toy gun comprises a dart sensor lever 10, a linkage 20, a transmission mechanism 30 and a pivot 40. Wherein, the pivot is fixed and attached to the gun body; the dart sensor lever 10 is linked with the pivot 40 to swing around it. The transmission mechanism 30 is arranged between the dart sensor lever 10 and the linkage 20 and is also linked with the linkage 20 for driving the linkage 20 to move.

The free end 120, which is close to one side of the pivot 40, of the dart sensor lever 10 droops freely at the position where the head part of the dart 3 in the barrel is located. The barrel 2 station in the magazine is located close to the barrel 2 station in the gun barrel 1 and is in front of the bullet station in the gun barrel 1 in the rotation direction of the magazine.

The contacting end 110, which is corresponding to the free end 120 and close to the other side of the pivot 40, of the dart sensor lever 10 is linked to the transmission mechanism 30. The specific link type, which depends on the structures of both the transmission mechanism 30 and the corresponding contacting end 110, can be contacting link, snap-fits or fixed connection, and so on.

Figures 2A, 2B:
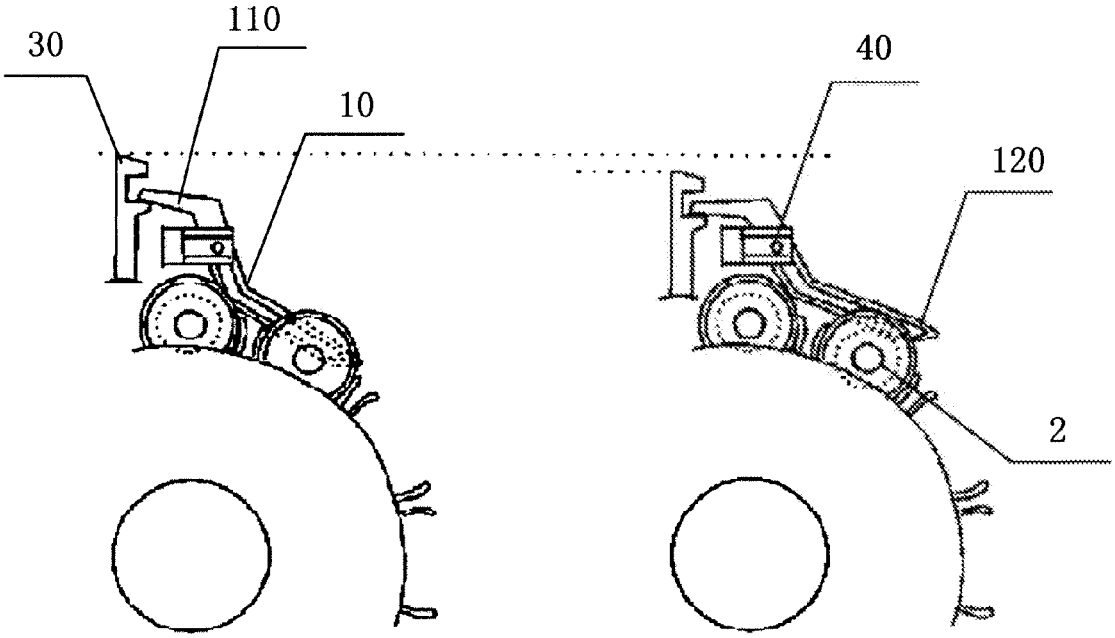
FIGS. 2A and 2B are structure diagrams for a transmission mechanism according to the first embodiment of the present invention.

In the first embodiment of the present invention, as shown in FIGS. 2A and 2B, a hook is provided at the tail end of the contacting end 110 of the dart sensor lever 10, while a groove coordinating with the hook is provided in the transmission mechanism 30. As the hook inserts into the corresponding groove, a snap-fits is formed between the contacting end 110 and the transmission mechanism 30. As shown in FIG. 2A, when the free end 120 of the dart sensor lever 10 is not lapped with a dart 3, the free end 120 droops freely without the effect of an external force. As shown in FIG. 2B, when the free end 120 of the dart sensor lever 10 is lapped with a dart 3, the free end 120 may deviate from its original location and tilt upward with the dart 3 pressing against the free end 120, so as to make the dart sensor lever 10 begin to swing around the pivot 40. Then during the swing, the dart sensor lever 10 drives the contacting end 110 to press downward in order to make the hook arranged at the tail end of the contacting end 110 pull down the transmission mechanism 30 in the groove arranged in the transmission mechanism 30. In the process of pulling down, the transmission mechanism 30 may move downward subsequently and its position may be lowered correspondingly, causing the linkage 20 linked therewith to move downward along with it finally. When the free end 120 of the dart sensor lever 10 is not lapped with a dart 3 again, the free end 120 of the dart sensor lever 10 may revert to the state of drooping freely, and the external force on the transmission mechanism 30 applied by the contacting end 110 has been removed. As a result, the transmission mechanism 30 may return to its original location; meanwhile, the linkage 20 may return to its original location as well.

Figures 3A, 3B:
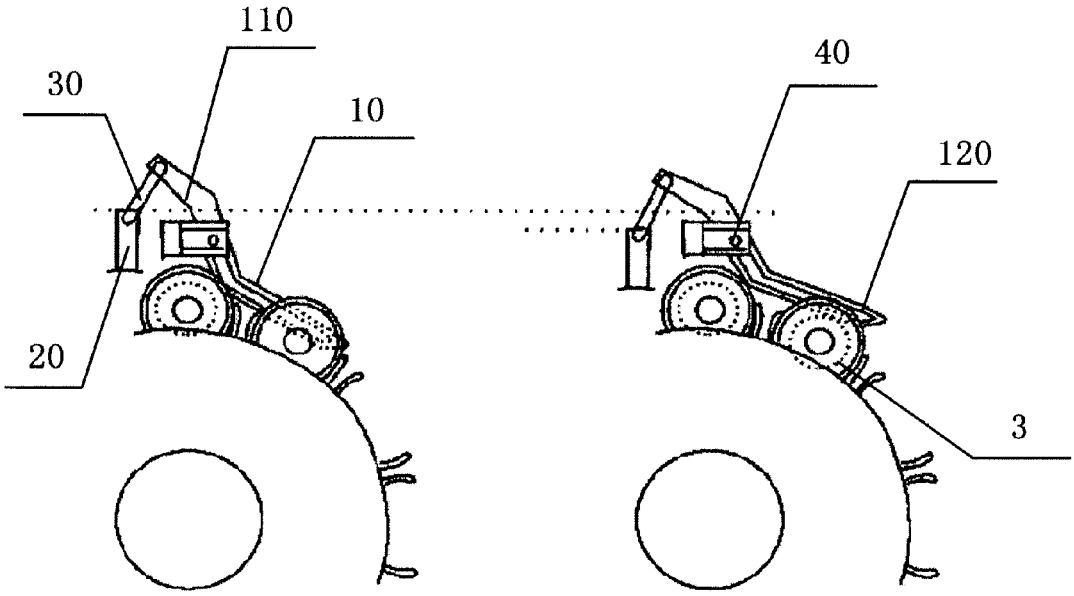
FIGS. 3A and 3B are structure diagrams for a transmission mechanism according to the second embodiment of the present invention.

In the second embodiment of the present invention, the transmission mechanism 30 is provided as a connecting rod, one end of which is linked with the contacting end 110 of the dart sensor lever 10 and the other end of which is linked with the linkage 20. As shown in FIG. 3A, when the free end 120 of the dart sensor lever 10 is not lapped with a dart, the free end 120 droops freely. As shown in FIG. 3B, when the free end 120 of the dart sensor lever 10 is lapped with a dart, as described above, the pressure upward by the dart may be transmitted to the linkage 20 through the swing of the dart sensor lever 10 and the transmission of the transmission mechanism 30 as the connecting rod.

Figures 4A, 4B:
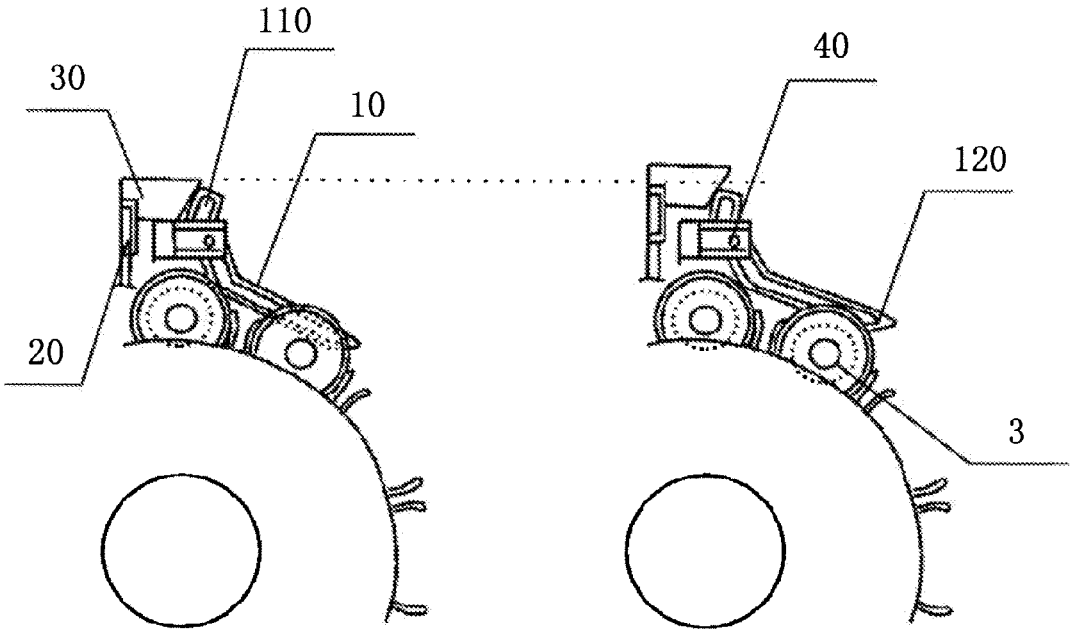
FIGS. 4A and 4B are structure diagrams for a transmission mechanism according to the third embodiment of the present invention.

In the third embodiment of the present invention, as shown in FIGS. 4A and 4B, the contacting end 110 may be contacting linked with the transmission mechanism 30 and the contacting surface of the transmission mechanism 30 is an inclined plane. As shown in FIG. 4A, when the free end 120 of the dart sensor lever 10 is not lapped with a dart, the free end 120 droops freely and the contacting end 110 leans to the inclined plane of the transmission mechanism 30. As shown in FIG. 4B, when the free end 120 of the dart sensor lever 110 is lapped with a dart, under the pressure upward by the dart, the free end 120 may deviate from its original location and tilt upward, so that the dart sensor lever 10 may begin to swing around the pivot 40. Then during the swing, the contacting end 110 is driven to press against the inclined plane of the transmission mechanism 30. As the contacting surface of the transmission mechanism 30 is an inclined plane, the pressure induced by pressing, which is perpendicular to the inclined plane, may have a component in the upward direction. Thus, under the pressure of the contacting end 110, the transmission mechanism 30 along with the linkage 20 in fixed connection with it may move upward together. When the free end 120 of the dart sensor lever 10 is not lapped with a dart, the free end 120 of the dart sensor lever 10 droops freely, and the pressure on the transmission mechanism 30 applied by the contacting end 110 has been removed, so the transmission mechanism 30 and the linkage 20 may return to its original location, respectively.

Three kinds of exemplary structures of the transmission mechanism 30 have been illustrated above. Of course, other transmission mechanisms can be utilized for the apparatus for detecting the dart in a barrel of a toy gun in the embodiment of the present invention. The exemplary embodiments described herein are provided for illustrative purpose, and not limiting. Other exemplary embodiments are possible, and modification may be made to the exemplary embodiments within the spirit and scope of the invention.

In a method for detecting the dart in a barrel of a toy gun according to the embodiment of the present invention, when the free end 120 of the dart sensor lever 10 is lapped with a dart 3, the apparatus for detecting the dart in a barrel of a toy gun as described above may be utilized to perform the following steps:

the free end 120 of the dart sensor lever 10 is lifted upward by the dart 3, so that the dart sensor lever 10 swings around a pivot 40;

a contacting end 110 of the dart sensor lever 10 is driven to press downward a transmission mechanism 30 linked therewith so as to move the transmission mechanism 30;

the transmission mechanism 30 begins to drive a linkage 20 linked therewith to move.

When the free end 120 of the dart sensor lever 10 is not lapped with a dart, each component may be in a free state without the effect an external force. As a result, no movements may occur.

It can be found from above that whether or not there is a dart 3 in a corresponding barrel 2 to be ejected can be detected by providing an apparatus for detecting the dart in a barrel of a toy gun in the toy gun and utilizing the corresponding method for detecting the dart in a barrel of a toy gun. Specifically, the dart 3 in the barrel 2 to be ejected may press against the dart sensor lever 10 so as to drive it to swing. After the effect of pressing has been transmitted to a transmission mechanism 30 linked with the dart sensor lever 10 through swinging, the transmission mechanism 30 may be driven to move correspondingly. During the moving, the transmission mechanism 30 may drive a linkage 20 linked therewith to move together with it. Finally, the information of which whether or not there is a dart in the barrel 2 to be ejected may be transmitted to other components in the toy gun, so that the ejection of the barrel 2 may be implemented. As a result, when the apparatus for detecting the dart in a barrel of a toy gun has been provided in the toy gun and the corresponding method for detecting the dart in a barrel of a toy gun has been utilized as well, a barrel with a dart therein will not be ejected out by mistake.

The invention claimed is:

1. An apparatus for detecting a dart in a barrel of a toy gun, comprising:

a dart sensor lever having a free end and a contacting end, a linkage, a transmission mechanism between said dart sensor lever and said linkage, and a pivot attached to a gun body;

wherein said dart sensor lever is attached to said pivot at a point between said free end and said contacting end such that said dart sensor lever swings around said pivot, said transmission mechanism is linked with said linkage for driving said linkage to move; and wherein the toy gun has a rotating magazine.

2. An apparatus for detecting a dart in a barrel of a toy gun according to claim 1, wherein said contacting end of said dart sensor lever is linked to said transmission mechanism while said free end of said dart sensor lever droops at a position where a head part of the dart in the barrel is located.

3. An apparatus for detecting a dart in a barrel of a toy gun according to claim 1, wherein said contacting end of said dart sensor lever is provided with a hook and said transmission mechanism is provided with a corresponding groove coordinating with said hook.

4. An apparatus for detecting a dart in a barrel of a toy gun according to claim 1, wherein said transmission mechanism is a connecting rod which is linked to said contacting end of said dart sensor lever.

5. An apparatus for detecting a dart in a barrel of a toy gun according to claim 1, wherein said contacting end of said dart sensor lever leans to said transmission mechanism; and said contacting surface of said dart sensor lever is an inclined plane.

6. A method for detecting a dart in a barrel of a toy gun, characterized in that the apparatus for detecting the dart in a barrel of a toy gun according to claim 1 is utilized in the method; when a free end of a dart sensor lever is lapped with a dart, the method comprises steps:

said free end of said dart sensor lever is moved by said dart, so that said dart sensor lever swing around a pivot;

a contacting end of said dart sensor lever is driven to press a transmission mechanism linked therewith so as to move said transmission mechanism;

said transmission mechanism drives a linkage linked therewith to move so as to transmit information of whether or not there is a dart in the barrel.

* * * * *